US008206519B2

(12) United States Patent
Howells et al.

(10) Patent No.: US 8,206,519 B2
(45) Date of Patent: Jun. 26, 2012

(54) ALUMINIUM FOIL ALLOY

(75) Inventors: Andrew David Howells, Ontario (CA); Hoellrigl Guenther, Rhein (CH); Armelle Daniélou, Les Echelles (FR); Florence Lauret, Rugles (FR)

(73) Assignee: Novelis, Inc., Toronto, Ontario (CA)

( * ) Notice: Subject to any disclaimer, the term of this patent is extended or adjusted under 35 U.S.C. 154(b) by 353 days.

(21) Appl. No.: 11/995,023

(22) PCT Filed: Jun. 29, 2006

(86) PCT No.: PCT/EP2006/006332
§ 371 (c)(1),
(2), (4) Date: Feb. 5, 2009

(87) PCT Pub. No.: WO2007/006426
PCT Pub. Date: Jan. 18, 2007

(65) Prior Publication Data

US 2011/0165015 A1 Jul. 7, 2011

(30) Foreign Application Priority Data

Jul. 8, 2005 (EP) ..... 05014016

(51) Int. Cl.
*C22F 1/04* (2006.01)

(52) U.S. Cl. ..... 148/551; 148/552

(58) Field of Classification Search ..... 148/551–552
See application file for complete search history.

(56) References Cited

U.S. PATENT DOCUMENTS

| | | | | |
|---|---|---|---|---|
| 4,671,985 | A * | 6/1987 | Rodrigues et al. | 428/215 |
| 5,503,689 | A | 4/1996 | Ward et al. | |
| 6,531,006 | B2 * | 3/2003 | Jin et al. | 148/551 |
| 2005/0207934 | A1 | 9/2005 | Gagniere et al. | |

FOREIGN PATENT DOCUMENTS

| | | | |
|---|---|---|---|
| JP | 60200943 | A | 10/1985 |
| JP | 03153835 | A | 7/1991 |
| WO | WO02064848 | A1 | 8/2002 |
| WO | WO03069003 | A2 * | 8/2003 |

OTHER PUBLICATIONS

English language translation of JP03153835 to Toma et al. Translated Feb. 2012.*

* cited by examiner

*Primary Examiner* — Stanley Silverman
*Assistant Examiner* — Brian Walck
(74) *Attorney, Agent, or Firm* — Robert L. Stearns; Dickinson Wright, PLLC

(57) ABSTRACT

The present invention relates to a method of making an aluminum alloy product having a gauge below 200 μm. It also relates to an aluminum alloy product having a gauge below the same value and to containers for food packaging application made from the aluminum alloy product. The invention is process of manufacturing an aluminum alloy comprising the following steps: continuous casting an aluminum alloy melt of the following composition, (in weight %): Fe 1.0-1.8, Si 0.3-0.8, Mn up to 0.25, other elements less than or equal to 0.05 each and less than or equal to 0.15 in total, balance aluminum, cold rolling the cast product without an interanneal step to a gauge below 200 μm and final annealing the cold rolled product.

16 Claims, 7 Drawing Sheets

ALUMINIUM FOIL ALLOY

FIELD OF THE INVENTION

The present invention relates to a method of making an aluminium alloy product having a gauge below 200 μm. It also relates to an aluminium alloy product having a gauge below the same value and to containers for food packaging applications made from this aluminium alloy product.

RELATED ART

Alloys of aluminium have been used for many years as a foil for household cooking purposes, food packaging and other applications. A series of alloy compositions have been developed for such uses and they include alloys based on the compositions AA8006, AA8011, AA8111, AA8014, AA8015, AA8021 and AA8079, (where these compositions are those designated by the internationally recognised standards of the Aluminum Association of America). Alloys of the 3XXX (series may also be used for foil applications, alloy AA3005 for example. Alloys of the AA8079 or AA8021 type have a high Fe content and a low Si content Alloys of the AA8011 type have a more balanced Fe and Si content and such compositional variations affect the kind of intermetallic phases formed during solidification, which in turn they affect the final annealing response.

In a continuous casting process the higher Si containing alloys are considered to reduce casting productivity because centre line segregation effects become worse at higher casting speeds.

In producing thin foil products it is usually considered that the rolled product must not become too hard otherwise it becomes difficult to roll the foil down to final gauge. For this reason, foil manufacturers typically incorporate an interannealing step to soften the cold rolled product before final cold rolling.

A product, which is just cold rolled, would have high strength (due to the work hardening) but limited ductility. In order to increase ductility and thus render the products suitable for manipulation and forming, a final annealing operation is carried out, either through a batch anneal or a continuous annealing line. The essential variables are temperature and time and, largely depending on these factors, processes of recovery, recrystallization and grain growth may proceed within the cold worked product. In thin gauge products like foil, the parameters are set to ensure that a small grain-sized structure is maintained, large grains having a detrimental impact on mechanical properties.

The microstructure of a cold rolled sheet or foil consists of fine grains of a micron scale and a high density of intermetallic phases formed during solidification. The intermetallics are broken down during rolling and have a typical particle size between 0.1 and 1.5 μm. This provides the main pre-requisite for an optimum annealing response. The other important metallurgical feature is the high cold rolling degree, resulting in a fine grain structure. However these grain structures are highly anisotropic. During recovery the number of dislocations is reduced and a sub-grain structure can form. With increasing time or temperature the sub-grain size gradually increases. Initially in such a case there is no appreciable change to the microstructure, with the product retaining much of its anisotropy. Whilst there is a significant drop in strength from the as cold rolled state and an increase in ductility, the ductility may not reach the levels achieved in a partially recrystallized material.

As the temperature or time increases recrystallization begins, being the gradual formation of a new, discernible, grain structure. Retarding forces, in the form of grain boundary precipitates/intermetallics pin the grain boundaries during recrystallization to restrict grain growth. The annealing treatment may, if there is sufficient supersaturated solute within the alloy matrix, also lead to the formation of fine intermetallic dispersoids. These too help to prevent grain growth.

It is the case, for some alloys, (of the high Fe/low Si variety for example), that optimum properties can only be achieved within a narrow annealing window, usually at high annealing temperatures. These higher temperatures are necessary because the high density of sub-micron particles mean that the grain boundary pinning effect is already high. In addition, during annealing, the precipitation of intermetallic dispersoids reinforces the grain boundary pinning effect. In effect there is no continuous recrystallization reaction at the low temperature range and it might only start at around 380° C. and above. Only when the dispersoids/intermetallics become coarser at higher temperatures do the pinning forces start to decline and grain reorganization is possible. However, since the temperatures for this are very high, the metal then enters a regime where the balance between the forces driving grain growth and grain boundary pinning is unstable and uncontrolled grain growth can appear suddenly.

Production routes where direct chill, (DC), casting is used are more complicated and expensive than continuous cast routes because they usually involve more processing steps, some of which are lengthy and energy intensive, such as homogenization. It is desirable, therefore, to use continuous casting initially to remove steps like homogenization and there has been substantial work in optimising alloys and processes with this in mind. But even with a continuous cast product to start with; reduction to final gauge usually involves an interannealing step, itself energy expensive and time consuming.

For most applications and application in deep drawn containers in particular, the ultimate strength of the alloy on its own is not the most important property. It is generally the case that as the strength of an alloy product increases the elongation will decline. In reality, alloy product design is always about optimising a balance of properties. A good balance in the case of deep drawn containers would be an optimum combination of strength and formability (reflected by tensile elongation). This balance can be assessed by multiplying the ultimate tensile strength (UTS) by the elongation at failure (E). In addition it is desirable for the alloy to have a good balance of properties in both the transverse and longitudinal directions because forming rarely, if ever, takes place in one dimension.

For some containers it is required that the container walls have a certain degree of stiffness. The stiffness of a material is closely related to its yield stress (YS). Therefore, good yield strength is also desirable. On the other hand if the YS is very close to the UTS an alloy product is not ideal for use in drawn containers. It is desirable that the alloy product demonstrates strain hardening during deformation because this helps to prevent necking during forming. An alloy product with a YS close to its UTS would possess different deformation characteristics with limited, if any, strain hardening.

With regard to deep drawn containers it is desirable for surface blackening to be avoided during forming operations which we have found to be related to the composition of the intermetallic phases after solidification.

In addition to these qualities it is desirable, as a means of reducing alloy costs through recycling, to be able to accommodate elements such as Mn within the melt composition.

Further, it is desirable, from an operational perspective, to be able to process an alloy product through different manufacturing operations to enable best use of a range of available equipment, such as batch and continuous annealing furnaces.

WO 03/069003 describes an alloy of the high Fe/low Si type produced via a continuous casting route. The alloy disclosed comprises, in weight %, Fe 1.5-1.9, Si<0.4, Mn 0.04-0.15, other elements and balance aluminium. The processing route used to make this product is to continuously cast the alloy, cold roll with an optional interanneal with a final anneal after cold rolling at between 200 and 430° C. for a period of at least 30 hours. The preferred batch annealing process is a two-stage process involving a first step between 200 and 300° C. and a second step between 300 and 430° C.

JP-A-03153835 discloses a fin material for use in heat exchangers where the alloy composition is, in weight %, Fe 1.1-1.5, Si 0.35-0.8, Mn 0.1-0.4, balance aluminium. The alloy was semi-continuously cast into water-cooled moulds of an internal size 30×150 mm, that is, on a laboratory scale. The casting was hot rolled, intermediately rolled, cold rolled with a maximum cold rolling reduction of 30% down to a thickness of 70 μm. The description of intermediate rolling followed by a smaller percentage of cold reduction suggests an intermediate anneal was used. Ultimate tensile strengths between 13.0 and 14.7 kg/mm$^2$ are reported (127-144 MPa), presumably in the longitudinal direction, but no information is provided about the YS, elongation or the transverse properties.

JP-A-60200943 discloses a similar alloy having a composition of, in weight %, Fe>1.25-1.75, Si 0.41-0.8, Mn 0.10-0.70, balance aluminium and impurities. This alloy was also developed for use as a fin material within brazed heat exchangers. The alloy was cast as an ingot, i.e. in a DC semi-continuous manner, homogenised at 580° C. for 10 hours and scalped. The ingots were then hot rolled at 525° C. to a gauge of 4 mm and intermediate annealed at 380° C. for 1 hour. They were then subjected to cold rolling down to a gauge of 0.35 mm, intermediate annealed for a second time in a continuous process with a temperature of 480° C. for 15 seconds and then final cold rolled to a gauge of 0.20 mm (i.e. 200 μm), and annealed at 205° C. for 10 minutes to simulate a paint bake treatment. One specific alloy has a YS of 13.7 kg/mm$^2$, (134 MPa), a UTS of 16 kg/mm$^2$; (157 MPa), but the elongation is reduced to 9%, giving a product of UTS×elongation of 1413. The same alloy is also shown with a YS of 4.916 kg/mm$^2$, (48 MPa), a UTS of 12.0 kg/mm$^2$, (118 MPa), and an elongation of 34%, giving a UTS×elongation value of 4012. There is no disclosure of the transverse mechanical properties. However, the treatment of 10 minutes at 205° C. is a recovery anneal. Such an anneal will retain the anisotropy of the cold working process.

WO 02/064848 describes a process for manufacturing a foil product where the alloy composition is, in weight %, Fe 1.2-1.7, Si 0.4-0.8, Mn 0.07-0.20, remainder aluminium and incidental impurities. The alloy is continuously cast using a belt caster, cold rolled with an interanneal at a temperature between 280-350° C., and final annealed. The final gauge is 0.3 mm, (300 μm), and the final anneal was a partial anneal by way of a batch process involving heating the cold rolled product to between 250 and 300° C. After this processing route the alloy of this disclosure developed a UTS of around 125-160 MPa and elongation values of between about 28 to 14.5%. Multiples of UTS and elongation can be calculated and they range from 2295 up to 3476. No data are shown concerning transverse properties or with respect to YS.

Further alloys are known and sold for food packaging applications. This includes alloys based on AA8011. AA8011 has a composition as follows, in weight %: Fe 0.6-1.0, Si 0.50-0.90, Cu<0.10, Mn<0.20, Mg<0.05, Cr<0.05, Zn<0.10, Ti<0.08, other elements <0.05 and total others <0.15, balance Al. An alloy with Fe at the lower end of this range is known, nominally Fe 0.65 and Si 0.65. This alloy is known with and without Mn and is known to be continuous cast and is used for non-demanding products like household foil. Another alloy is known with a nominal Fe content of 1.1 and Si also at 1.1. In these alloys, where the ratio of Fe to Si is 1:1, the addition of Mn leads to an unstable annealing response at temperatures of 320° C. and above. As a result Mn is avoided in such alloys.

SUMMARY OF THE INVENTION AND ADVANTAGES

It is an object of this invention to provide a new and economic method of manufacturing an aluminium alloy product, a method that leads to a combination of good mechanical properties in terms of the balance between strength and elongation in both longitudinal and transverse directions, which avoids the creation of blackening deposits during deep drawing operations and which provides wide processing windows for either a batch annealed or continuous annealed product.

It is a further object of this invention to provide aluminium alloy products displaying an enhanced combination of properties particularly useful in the manufacture of deep-drawn containers thereby being easy to form and not prone to surface blackening defects.

Accordingly a first aspect of the invention is a process of manufacturing an aluminium alloy product comprising the following steps:

(a) continuous casting an aluminium alloy melt of the following composition, (in weight %):
  Fe 1.0*1.8
  Si 0.3-0.8
  Mn up to 0.25
  other elements less than or equal to 0.05 each and less than or equal to 0.15 in total
  balance aluminium
(b) cold rolling the cast product without an interanneal step to a gauge below 200 μm
(c) final annealing the cold rolled product The alloy composition is chosen to create the appropriate balance of intermetallics after solidification, control their size distribution (and hence effect on the annealing reaction), all of which determines the final microstructure and hence the property balance. By combining the alloy composition with this process route a microstructure is developed which has a good balance between the forces driving grain boundary mobility and the retarding forces necessary to stabilise the grain size. This balance is stable over a wider range of annealing conditions leading to greater flexibility in manufacturing operations. This is because the supersaturated solute of Fe and Mn (which leads to dispersoid formation during annealing) and the intermetallic particles from the cast structure both act as retarding forces against grain coarsening. In addition to this, it is possible to achieve high isotropic YS, UTS and elongation values and to reduce surface blackening during forming operations.

The composition of the alloy is described, in particular with respect to other elements and the balance aluminium, in the same way as recognized by the Aluminum Association Register of International Alloy Designations and Chemical Composition Limits for Wrought Aluminum and Wrought Aluminum Alloys.

Fe is added to provide mechanical strength although, because the structure is dependent on the kind of intermetallics and dispersoids formed, its content should preferably be considered together with the Mn and Si content. If the Fe content is too low the resulting mechanical strength will be too low. If the Fe content is too high it will promote coarse intermetallic phases to appear and these phases can be detrimental to the surface quality of drawn containers. Preferred embodiments are that the amount of Fe present is between 1.1 and 1.7 weight %, and more preferably between 1.2 and 1.6 weight %.

The presence of Si helps reduce the solid solution of Fe and Mn, enabling continuous recrystallization to start within a low temperature annealing range. The addition of Si in combination with Fe helps promote the formation of cubic α-Al(FeMn)Si phase and it has been found that a predominance of this phase instead of the Si-free Al(FeMn) or of the monoclinic β-form of AlFeSi helps avoid smut formation and blackening during deep drawing. It is a preferred feature of the invention that the predominant intermetallic phase present be cubic α-Al(FeMn)Si. If the Si content is too low the precipitates will be of the binary AlFe type. If the Si content reaches close to parity with the Fe content, as with the balanced AA8011 type alloys mentioned above, the α-phase is less likely to form and, instead, the β-form of AlFeSi will be formed.

It is believed that the cubic α-phase has a better adhesion to the matrix compared with the monoclinic β-form or $Al_M$(FeMn) phases, (M=4-6), and that, during forming, is less likely to detach. As a result the cubic α-phase is less likely to stick to the die surface and cause damage to the aluminium surface. An alternative hypothesis is that the shape of the cubic α-phase during and after cold working has an effect. Because it is more rounded than the angular monoclinic β-form, fewer aluminium fines are generated during rolling and other forming operations. Fewer fines result in reduced surface damage. In order to promote the formation of the cubic α-phase, therefore, Si is present within the range 0.3 to 0.8 weight %, preferably within the range 0.4 to 0.7 weight %, and more preferably from 0.5 to 0.7 weight %. The Fe:Si ratio is preferably between 1.5 and 5, more preferably between 1.5 and 3.

Mn also promotes the formation of the cubic α-AlFeSi phase. In addition, Mn provides a small strengthening effect. If the Mn content is too high segregation problems will be encountered within the continuously cast product and the cast product would have to be homogenized. For this reason, if present, Mn is present in an amount up to 0.25%. Since it is desirable to be able to use recycled scrap and to gain the benefit of promoting the appropriate phase formation, it is preferred that Mn is present in an amount above 0.05 weight %. It is further preferred that Mn be present in an amount between 0.05 and 0.20 weight %.

Although the continuous casting can be carried out in a variety of ways including belt casting, a preferred method is to employ twin roll casting. A preferred thickness of the cast product is between 2 and 10 mm, more preferably between 3 and 8 mm.

With regard to step (b), preferred embodiments are that the final gauge after cold rolling be below 160 μm, more preferably below 165 μm. It is preferred that the gauge be above 35 μm, more preferably above 60 μm, more particularly where the intended application is in food packaging containers.

With regard to step (c), the final annealing may be performed by a batch process or by a continuous annealing process. The final annealing process establishes the final balance of mechanical properties for the aluminium strip product. As explained above it is important during this stage to be able to control the recovery/recrystallization reaction taking place within the cold worked metal. In reality, with this alloy and the inventive process it is possible to use a wide range of annealing conditions and achieve good mechanical properties.

In the event a batch process is used, the temperature of the anneal is between 300 and 420° C. The product according to the invention is so stable during annealing that the duration can be very long, with times of up to 60 hours and more being possible, this duration being inclusive of both the slow heat up to temperature and the hold at temperature. However, since an excellent combination of properties can be achieved at shorter annealing durations and because of a desire to minimize energy costs, it is preferred that the duration of the batch anneal be between 10 and 45 hours.

In the event a continuous anneal is used the temperature of the annealing treatment is between 400 and 520° C., preferably between 450 and 520° C. The duration the strip spends within the furnace is much shorter, usually of the order of seconds, for instance between 4 and 10 seconds, and is usually adjusted to bring about the necessary microstructural transformation during the annealing step. Continuous annealing on an industrial line can be simulated by immersing samples into furnaces set at lower temperatures but for longer durations.

The skilled person will understand that there is a range of factors to consider in controlling the continuous annealing operation. For example one might vary the speed of the metal through the furnace depending on the gauge of the strip, the heat transfer conditions within the furnace (which can vary from furnace to furnace depending on the movement of air within the furnace) and the maximum set furnace temperatures. Establishing optimum conditions for each continuous annealing line is an established practice within the industry. With this invention it is possible to operate the continuous annealing line with a wide range of settings and achieve the same results.

Following this process route it is possible to obtain an improved alloy product compared with the prior art alloy products mentioned above.

A second aspect of the invention is an aluminium alloy product having a gauge below 200 μm and comprising the following alloy composition in weight Fe 1.0-1.8
Si 0.3-0.8
Mn up to 0.25
other elements less than or equal to 0.05 each and less than or equal to 0.15 in total
balance aluminium
wherein the aluminium alloy product possesses the following properties:
in the transverse direction:
a yield stress >100 MPa
a UTS>130 MPa
an elongation >19%, and
a product of UTS×elongation >2500
and in the longitudinal direction:
a yield stress >100 MPa
UTS >140 MPa
an elongation >18%, and
a product of UTS×elongation >2500.

The alloy product of the second aspect of the invention is obtainable by the process of the first aspect of the invention.

The same matters with regard to intermetallic phases and their influence on the annealing reaction of the product should be borne in mind and therefore the composition may be more preferably controlled in the same way as described above.

With regard to the mechanical properties it is preferred that the transverse yield stress is >110 MPa, more preferably >120 MPa and it is preferred that the longitudinal yield strength is >110 MPa, more preferably >120 MPa.

It is preferred that the transverse UTS be greater than 135 MPa, more preferably >140 MPa. It is preferred that the longitudinal UTS be greater than 150 MPa.

The transverse elongation for the inventive alloy product is preferred to be above 20% and more preferred to be 22%. The longitudinal elongation is preferred to be above 19% and more preferred to be above 20%.

For the product of ultimate tensile strength and elongation, for the transverse direction this is preferably >3000 and, in the longitudinal direction, it is preferred if this product is >3000.

The process and product according to invention has a very useful balance of properties and adaptability such that its use can be contemplated within a wide range of typical foil applications including but not limited to, deep drawn containers, smooth-walled or wrinkle-walled containers and household cooking foil.

THE DRAWINGS

DETAILED DESCRIPTION

Figure 1:
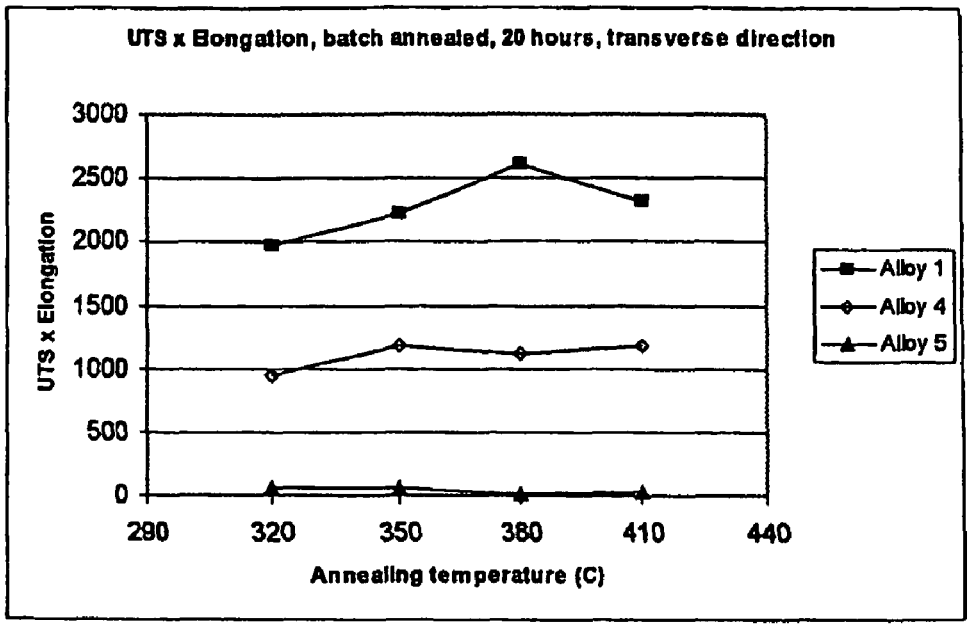
FIGS. 1-6 are graphs showing mechanical properties of exemplary inventive alloys compared to a prior art alloy as a function of batch annealing temperature, time and direction.

The invention will now be illustrated by reference to the following examples, tables and figures. Examples 1 to 3 relate to batch annealing in the final anneal and Examples 4 and 5 relate to continuous annealing in the final anneal. All mechanical tests were carried out according to DIN-EN 10002. The YS and UTS values are always stated in MPa and elongation (E) as a percentage. "T" refers to the transverse direction, "L" to the longitudinal. All alloy contents are expressed in weight %.

EXAMPLE 1

Table 1 summarises the alloy compositions investigated. Alloys 1 and 2 are alloys within the scope of the invention. Alloy 4 is an AA8011 type alloy with Fe towards the lower end of the composition range, i.e. similar to products commercially available, but with an addition of Mn. Alloy 5 is an alloy according to the prior art WO 03/069003. For each composition the other elements were <0.05 each and <0.15 in total with the balance Al.

All alloys were continuously cast in a twin roll caster to the gauges shown in Table 1. They were then cold rolled on a lab-scale cold mill to a final gauge of 150 μm without an interannealing step. Each cold rolled product of alloys 1, 4 and 5 was then subjected to batch annealing treatments at 320, 350, 380 and 410° C. for periods of 20, 40 and 60 hours. Alloy 2 was batch annealed at these temperatures for a duration of 45 hours. Alloy 5 in particular, was found to have very inconsistent mechanical properties due to a completely different tensile deformation behaviour. As mentioned above, in order to assess the balance of strength and ductility the product of UTS and elongation was calculated. The mechanical properties are shown in Tables 2, 3 and 4 and in FIGS. 1 to 6.

TABLE 1

Main alloying elements.

| Alloy | Fe | Si | Mn | Fe:Si ratio | As-cast gauge, (mm) |
|---|---|---|---|---|---|
| 1 | 1.19 | 0.62 | 0.10 | 1.92 | 6.05 |
| 2 | 1.60 | 0.62 | 0.10 | 2.58 | 6.28 |
| 4 | 0.67 | 0.65 | 0.10 | 1.03 | 5.99 |
| 5 | 1.75 | 0.14 | 0.11 | 12.5 | 6.16 |

TABLE 2

Tensile test data after batch annealing for 20 hours

| Alloy | | 320° C. T | 350° C. T | 380° C. T | 410° C. T | 320° C. L | 350° C. L | 380° C. L | 410° C. L |
|---|---|---|---|---|---|---|---|---|---|
| 1 | YS | 108.8 | 103.5 | 94.3 | 88.3 | 104.9 | 101.6 | 93 | 87.9 |
| | UTS | 138.8 | 138.5 | 140.0 | 136.4 | 141.3 | 144.2 | 146.3 | 146.6 |
| | E | 14.2 | 16.1 | 18.7 | 17.0 | 13.9 | 23.9 | 17.3 | 15.6 |
| | UTS × E | 1971 | 2230 | 2618 | 2319 | 1964 | 3446 | 2531 | 2287 |
| 4 | YS | 92 | 46.9 | 42.9 | 41.6 | 87.7 | 53.3 | 49.4 | 48.3 |
| | UTS | 121.6 | 106.0 | 106.4 | 106.6 | 125.8 | 117.6 | 122.7 | 122.5 |
| | E | 7.8 | 11.1 | 10.5 | 11.1 | 17.4 | 13.6 | 12.4 | 11.2 |
| | UTS × E | 948 | 1177 | 1117 | 1183 | 2189 | 1599 | 1521 | 1372 |
| 5 | YS | 173.8 | 179.3 | 161.9 | 145 | 167.6 | 171.4 | 161.9 | 160.6 |
| | UTS | 181.9 | 181.8 | 166.7 | 156.3 | 179.2 | 176.6 | 168.6 | 164.0 |
| | E | 0.3 | 0.3 | 0.1 | 0.2 | 8.0 | 11.7 | 13.6 | 16.4 |
| | UTS × E | 55 | 55 | 17 | 31 | 1434 | 2066 | 2293 | 2690 |

TABLE 3

Tensile data after batch annealing for 40 hours (45 hours for alloy 2)

| Alloy | | 320° C. T | 350° C. T | 380° C. T | 410° C. T | 320° C. L | 350° C. L | 380° C. L | 410° C. L |
|---|---|---|---|---|---|---|---|---|---|
| 1 | YS | 101.4 | 95.3 | 83 | 77.6 | 99.9 | 91.8 | 84 | 77.6 |
| | UTS | 136.7 | 137.1 | 136.3 | 138.6 | 141.5 | 141.3 | 144.8 | 150.2 |
| | E | 12.5 | 17.8 | 17.4 | 19.8 | 13.7 | 17.8 | 19.9 | 19.9 |
| | UTS × E | 1709 | 2440 | 2372 | 2744 | 1939 | 2515 | 2882 | 2989 |
| 2 | YS | 116.3 | 107.1 | 99.5 | 87.9 | 114.6 | 105.5 | 98.2 | 87 |
| | UTS | 149.9 | 148.2 | 149.5 | 143.8 | 152.9 | 152.2 | 154.3 | 148.5 |
| | E | 23.5 | 20.1 | 21.8 | 25.1 | 21.4 | 26.4 | 23.3 | 20.9 |
| | UTS × E | 3523 | 2979 | 3259 | 3609 | 3272 | 4018 | 3595 | 3104 |
| 4 | YS | 48.1 | 43.8 | 41.4 | 40.5 | 52.4 | 48.9 | 48.9 | 46.1 |
| | UTS | 105.8 | 105.5 | 107.7 | 107.5 | 115.8 | 119.5 | 122.5 | 124.6 |
| | E | 12.2 | 10.1 | 10.6 | 10.6 | 12.4 | 12.7 | 11.9 | 10.9 |
| | UTS × E | 1291 | 1066 | 1142 | 1140 | 1436 | 1518 | 1458 | 1358 |
| 5 | YS | 171 | 165.1 | 101 | 137.1 | 171 | 161.2 | 152.3 | 137.5 |
| | UTS | 173.2 | 168.4 | 150.0 | 139.9 | 176.0 | 167.0 | 154.4 | 144.5 |
| | E | 0.2 | 0.2 | 0.2 | 3.0 | 8.0 | 15.2 | 20.7 | 14.9 |
| | UTS × E | 35 | 34 | 30 | 420 | 1408 | 2538 | 3196 | 2153 |

TABLE 4

Tensile data after batch annealing for 60 hours

| Alloy | | 320° C. T | 350° C. T | 380° C. T | 410° C. T | 320° C. L | 350° C. L | 380° C. L | 410° C. L |
|---|---|---|---|---|---|---|---|---|---|
| 1 | YS | 97.3 | 88.3 | 82.8 | 72.6 | 99.3 | 87.3 | 81.1 | 71.6 |
| | UTS | 135.3 | 124.6 | 138.2 | 138.3 | 141.4 | 131.9 | 145.6 | 142.6 |
| | E | 20.9 | 15.4 | 23.0 | 17.7 | 21.2 | 25.5 | 15.6 | 17.8 |
| | UTS × E | 2828 | 1919 | 3179 | 2448 | 2998 | 3363 | 2271 | 2538 |
| 4 | YS | 47.3 | 42.3 | 41.2 | 39.3 | 52.8 | 47.8 | 47.9 | 50.9 |
| | UTS | 105.0 | 102.8 | 105.4 | 106.2 | 117.7 | 114.1 | 123.3 | 119.4 |
| | E | 11.0 | 11.3 | 9.6 | 10.1 | 11.5 | 11.9 | 11.3 | 11.3 |
| | UTS × E | 1155 | 1162 | 1012 | 1073 | 1354 | 1358 | 1393 | 1349 |
| 5 | YS | 163.9 | 158 | 145.4 | 128.1 | 160 | 156.1 | 145 | 129.7 |
| | UTS | 166.9 | 165.1 | 150.7 | 133.9 | 168.9 | 162.2 | 150.5 | 142.2 |
| | E | 0.2 | 0.2 | 0.4 | 5.4 | 10.2 | 14.7 | 17.2 | 17.9 |
| | UTS × E | 33 | 33 | 60 | 723 | 1723 | 2384 | 2589 | 2545 |

Figure 2:
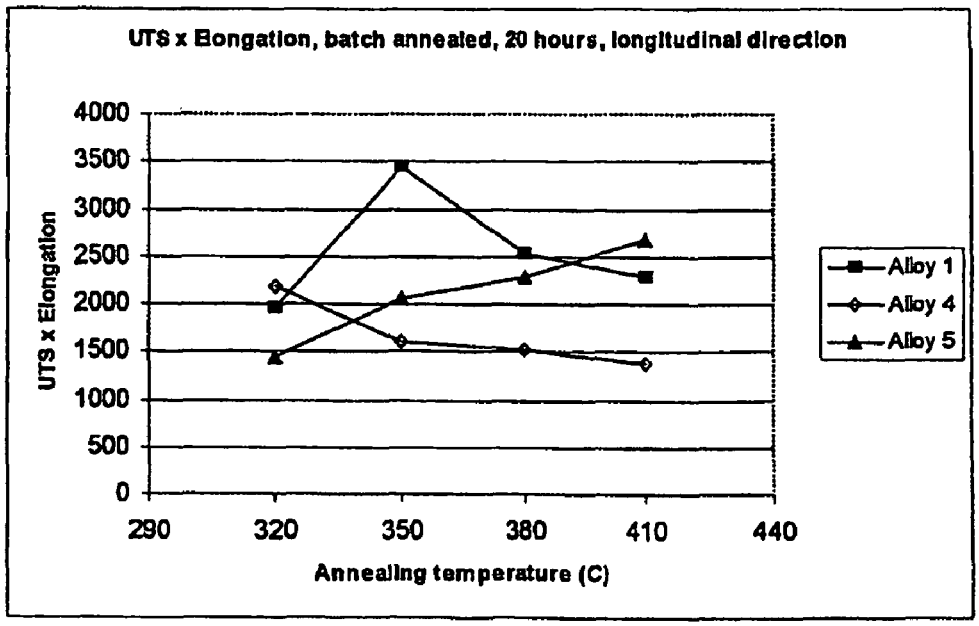
Figure 3:
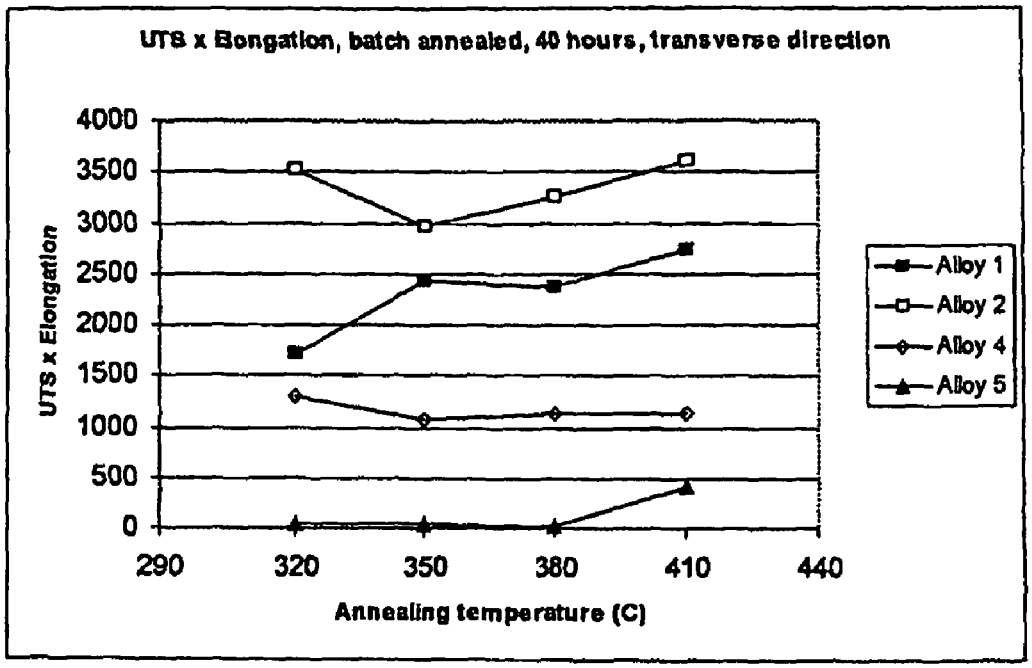
Figure 4:
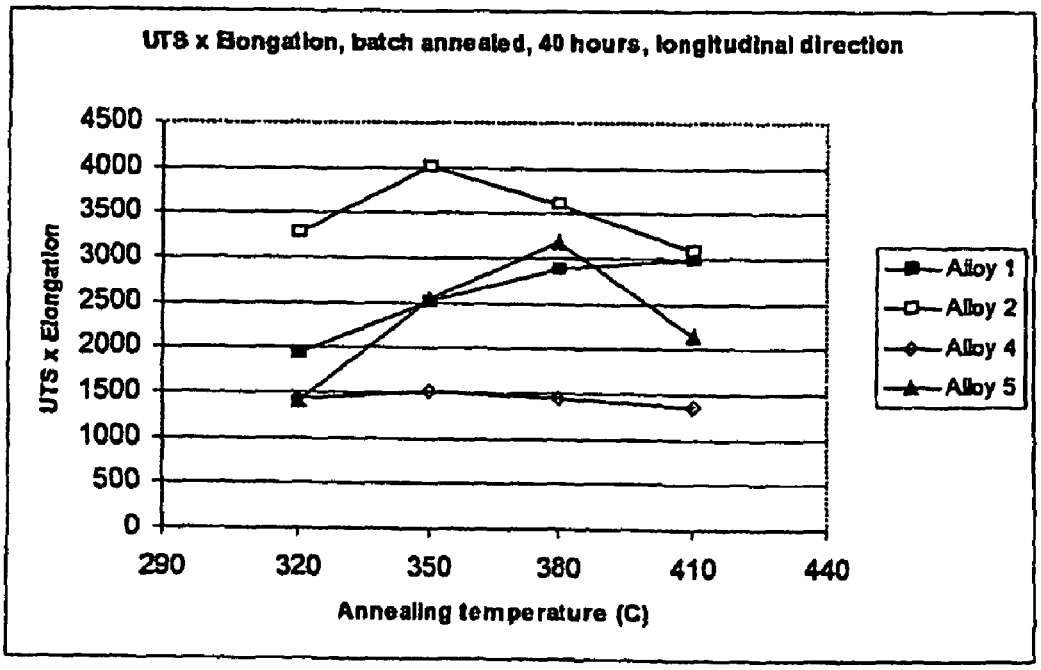
Figure 5:
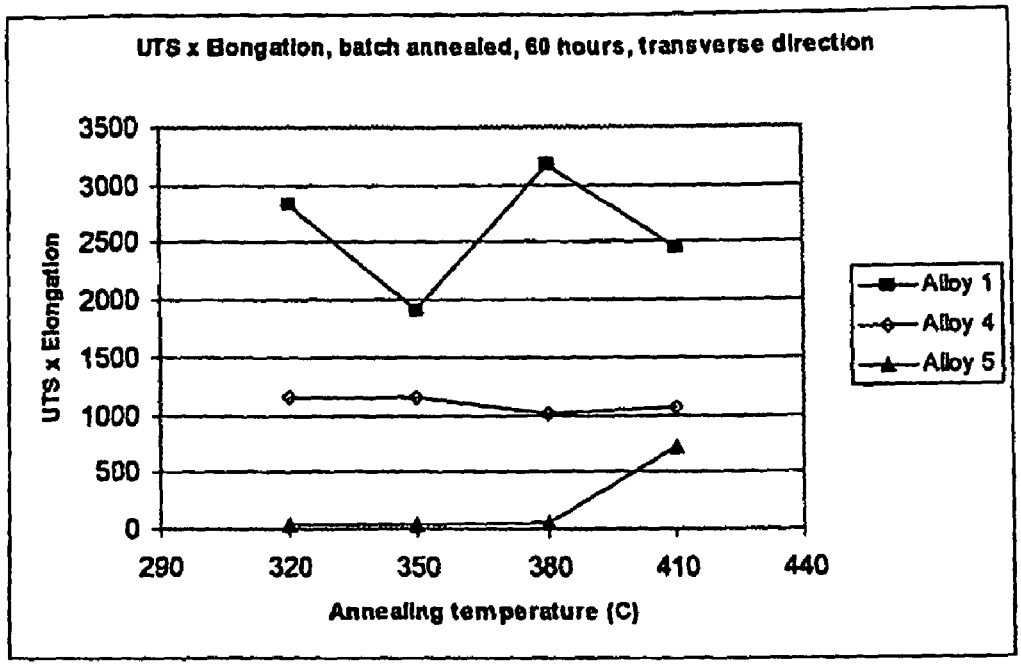
Figure 6:
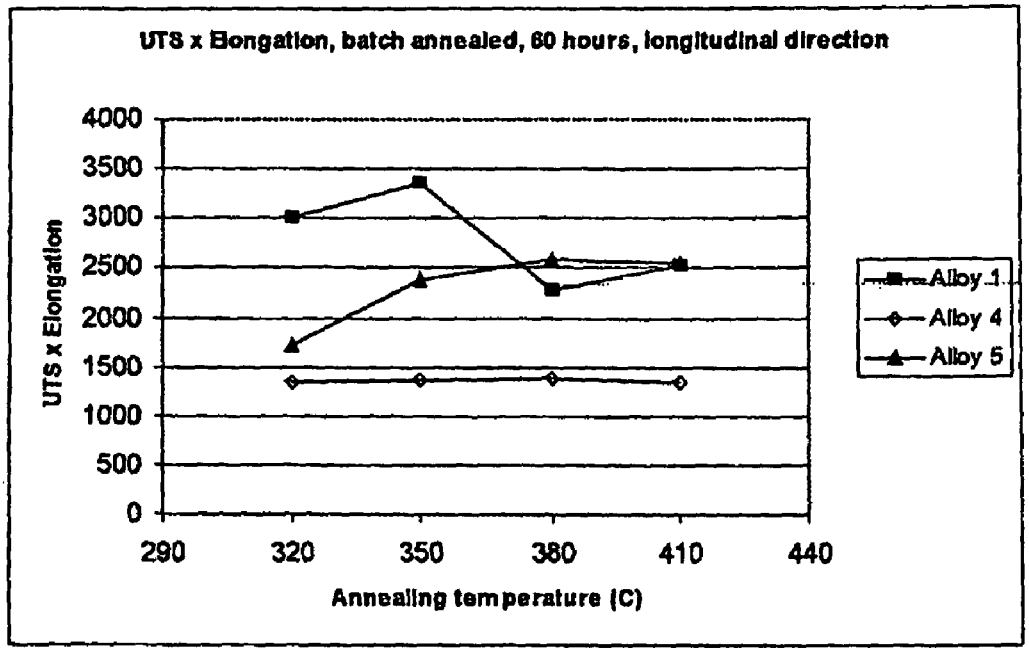

As can be seen, in FIGS. 1, 3 and 5, the inventive alloy 1 always has the better combination of UTS and elongation in the transverse direction compared with alloys 4 or 5. In the longitudinal direction, (as shown by FIGS. 2, 4 and 6), alloy 5 is able to match the combination of UTS and elongation only when it is annealed at high temperatures. As described above, at such temperatures there is an increased danger of uncontrolled recrystallization and coarse grain growth and this is not satisfactory from an industrial processing perspective. Alloy 2, also according to the invention, provides the best combination of properties; a combination that alloy 5 did not match. These results show that the process according to the invention provides a superior product and enables manufacturers to choose from a wider range of annealing conditions.

EXAMPLE 2

Alloy 1 was continuously cast in a twin roll caster to the same gauge as in Table 1 and then cold rolled on a lab-scale cold mill to a gauge of 1.5 mm. At this point, some samples were subject to an interanneal and others were not. For those interannealed, the heat up rate was 50° C. per hour and they were held at a temperature of 320° C. for 4 hours. They were then air-cooled. All samples were then cold rolled to a final gauge of 210 μm. Samples of the cold rolled product, with and without the interanneal, were subjected to four final batch annealing treatments. All the anneals were for a duration of 4 hours and at temperatures of 250, 300 and 350° C.

The processing route with an interanneal at 320° C. and the final anneal 300° C. reflects the recommended production route from WO 02/064848. The mechanical properties of alloy 1 after these treatments are given in Table 5 and FIGS. 8 to 13. They show there is a significant difference between the mechanical properties attainable with the current invention and the product manufactured according to WO 02/064848.

TABLE 5

| | | L | L | L | T | T | T |
|---|---|---|---|---|---|---|---|
| | | Anneal Temp (° C.) | | | | | |
| IA | | 250 | 300 | 350 | 250 | 300 | 350 |
| Without | YS | 142.6 | 112.5 | 93.7 | 150.2 | 114.9 | 94.1 |
| | UTS | 159.8 | 144.4 | 136.7 | 163.6 | 144.1 | 134 |

TABLE 5-continued

| | | L | L | L | T | T | T |
|---|---|---|---|---|---|---|---|
| | | Anneal Temp (° C.) | | | | | |
| IA | | 250 | 300 | 350 | 250 | 300 | 350 |
| | E | 18.8 | 25 | 20.6 | 15.4 | 25.1 | 28.2 |
| | UTS × E | 3004 | 3610 | 2816 | 2519 | 3616 | 3778 |
| With | YS | 130.7 | 69.8 | 51.4 | 137.2 | 67.5 | 48 |
| | UTS | 150.2 | 124.1 | 116.9 | 154.4 | 123.1 | 114.1 |
| | E | 16.8 | 20 | 19.9 | 10.3 | 17.5 | 18.2 |
| | UTS × E | 2523 | 2482 | 2326 | 1590 | 2154 | 2076 |

The mechanical properties of alloy 1 after processing according to WO 02/064848 are always lower than the new inventive method in both longitudinal and transverse directions. In particular, the YS for the interannealed samples was considerably lower when the final anneal was 300° C. and above.

To investigate the effect of interannealing on properties after continuous annealing, samples of alloy 1 processed in the same way as described in this Example above to a gauge of 210 m, with and without interanneal, were immersed in a furnace at 350 C for 10 minutes to simulate a continuous anneal. The transverse properties are shown in Table 6.

TABLE 6

| IA | | |
|---|---|---|
| Without | YS | 101.5 |
| | UTS | 149.6 |
| | E | 24.1 |
| | UTS × E | 3605 |
| With | YS | 53.9 |
| | UTS | 123 |
| | E | 25.5 |
| | UTS × E | 3136 |

As with the batch annealing, the YS of the interannealed version was very much inferior to the inventive method.

EXAMPLE 3

In order to demonstrate the typical level of properties achievable on an industrial scale and at different gauges, alloy 2 was continuously cast by twin roll casting to the same gauge as in Example 1 and cold rolled on an industrial cold mill to gauges of 78, and 116 μm without interanneals using conventional cold rolling pass schedules. The cold rolled product of gauge 78 μm was batch annealed at 350° C. for 25 hours and the 116 μm gauge product was annealed at 320° C. for 30 hours. The mechanical test results are shown in Table 7.

TABLE 7

| Gauge (μm) | | T | L |
|---|---|---|---|
| 78 | YS | 112 | 110 |
| | UTS | 138 | 143 |
| | E | 23 | 24 |
| | UTS × E | 3174 | 3432 |
| 116 | YS | 125 | 126 |
| | UTS | 156 | 158 |
| | E | 28.9 | 30 |
| | UTS × E | 4508.4 | 4740 |

Whilst Examples 1 and 2 illustrate the relative advantages of the inventive process as applied to alloys 1 and 2 over the prior art, this Example illustrates the kind of properties attainable in full industrial production.

Lab-scale cold rolling, as used in Examples 1 and 2, involves different thermal and strain conditions. In an industrial mill the strip is deformed/reduced in gauge to a greater extent through each pass. As a result its temperature rises, towards 100° C. and above. After a pass the warm strip is coiled and the thermal mass means a coil retains heat for some time. As the temperature rises recovery can start such that recovery is taking place both during further rolling and when the metal is in a coil. Recovery taking place like this is known as dynamic recovery and, since recovery enhances ductility, explains the enhanced properties seen after industrial scale processing, especially with respect to elongation.

EXAMPLE 4

Figure 7:
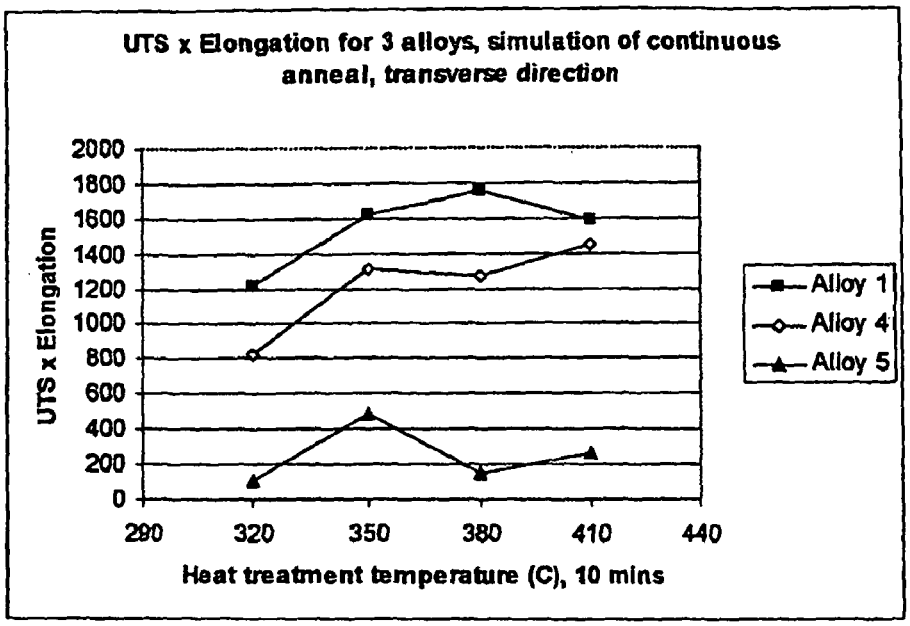
FIG. 7 is a graph showing mechanical properties of the same alloys as in FIGS. 1-6 as a function of continuous annealing temperature measured in the transverse direction of rolling.
Figure 8:
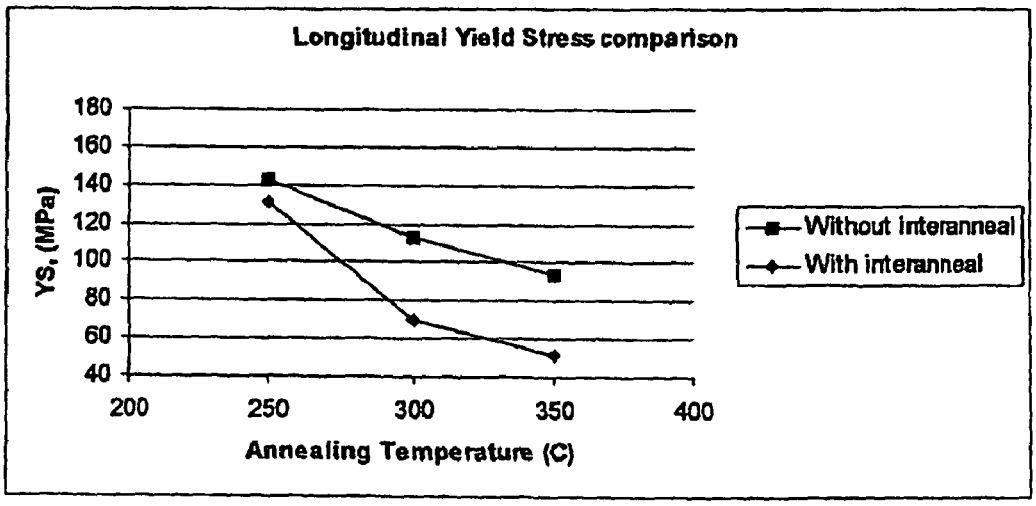
FIGS. 8-13 are graphs showing various mechanical properties of an exemplary alloy of the invention as a function of annealing temperature with and without an interanneal step.
Figure 9:
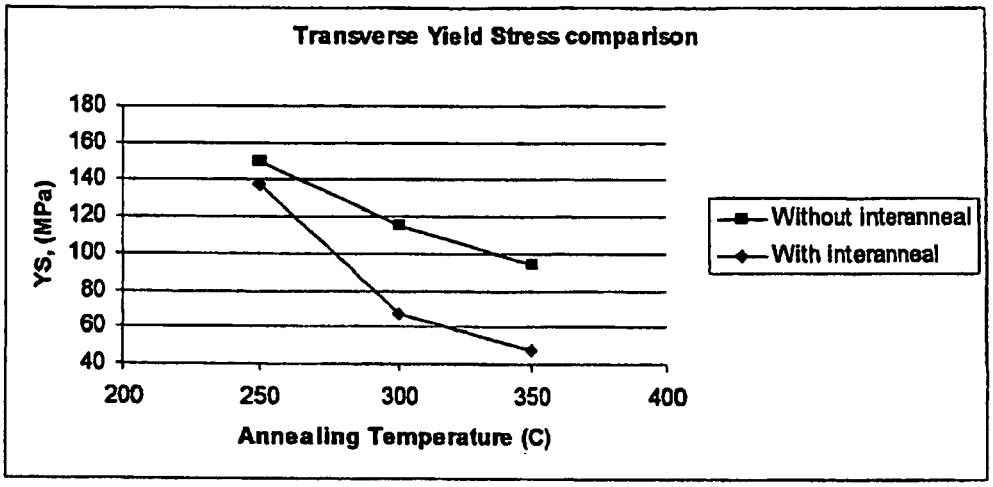
Figure 10:
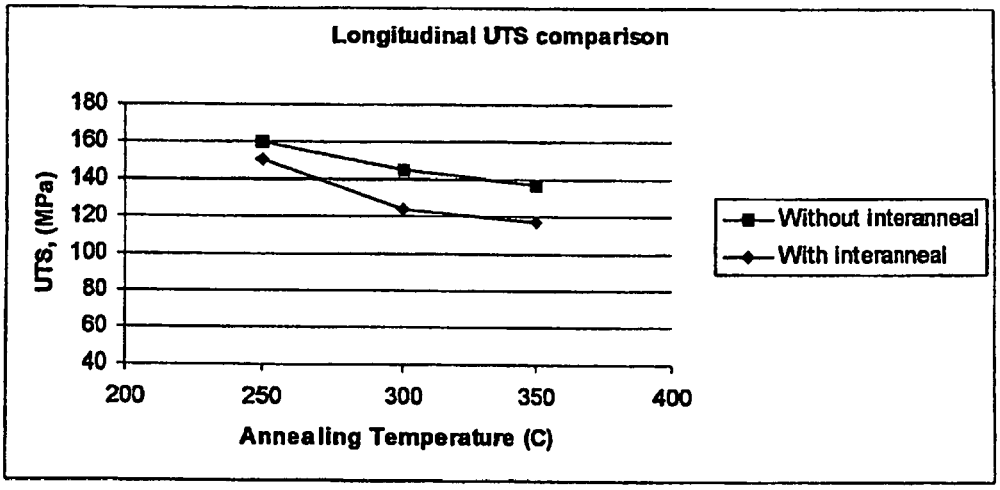
Figure 11:
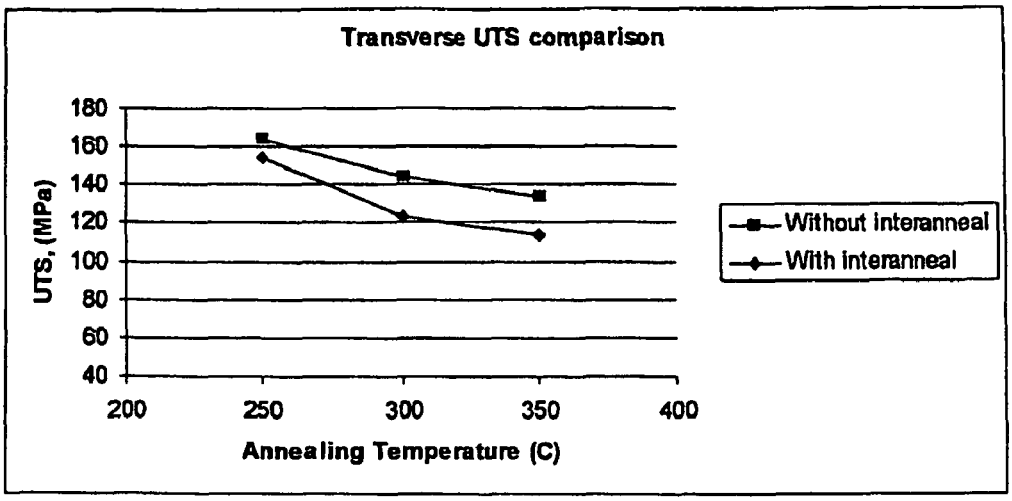
Figure 12:
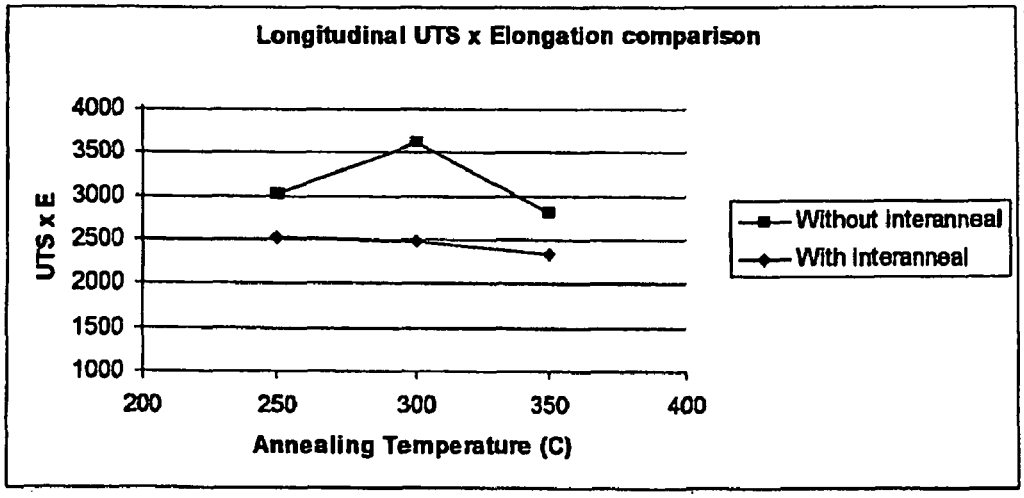
Figure 13:
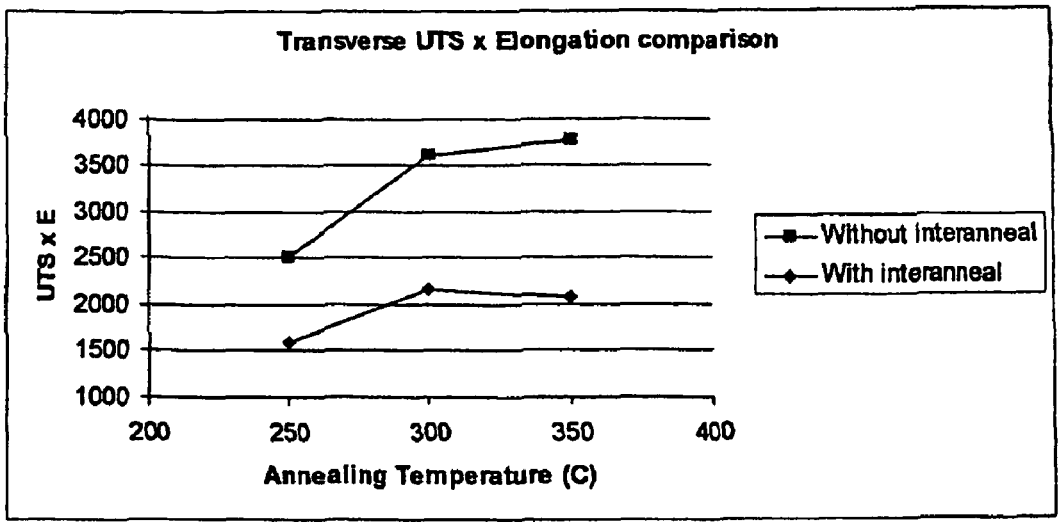

Alloys 1, 4 and 5 were cast and rolled to a final gauge in the same way as described in Example 1. They were then immersed into a hot furnace for 10 minutes at each of the following temperatures, 320, 350, 380 and 410° C. to simulate an industrial-scale continuous annealing line. The mechanical properties in the transverse direction only are shown in Table 8 and in FIG. 7. Only the transverse properties are shown because it is the transverse properties that usually represent the worst case scenario for ductility. Good ductility in the transverse direction usually corresponds to good ductility in the longitudinal direction.

TABLE 8

| | | Annealing temperature | | | |
|---|---|---|---|---|---|
| Alloy | | 320° C. | 350° C. | 380° C. | 410° C. |
| 1 | YS | 133.6 | 98.2 | 85.1 | 66.4 |
| | UTS | 157.9 | 143.4 | 141.8 | 137.8 |
| | E | 7.7 | 11.3 | 12.4 | 11.5 |
| | UTS × E | 1216 | 1620 | 1758 | 1585 |
| 4 | YS | 136.4 | 75.3 | 51.5 | 49.8 |
| | UTS | 150.2 | 124.6 | 114.7 | 117.2 |
| | E | 5.5 | 10.5 | 11.1 | 12.4 |
| | UTS × E | 826 | 1308 | 1273 | 1453 |
| 5 | YS | 191.2 | 180.6 | 175.7 | 156.5 |
| | UTS | 207.3 | 193.2 | 180.6 | 164.5 |
| | E | 0.5 | 2.5 | 0.8 | 1.6 |
| | UTS × E | 103 | 483 | 144 | 263 |

As shown by these results, the inventive alloy 1 always had the better balance of mechanical properties. Although the elongation values measured here for the process of the invention are relatively low, it should be remembered that these tests were conducted on foil rolled using a lab-scale mill. Therefore they did not experience the kind of dynamic recovery process necessary to provide optimum properties. But these results do show the relative combination of properties for different alloys. Indeed, these data serve to illustrate that alloy 5 cannot be continuously annealed, rendering it a less adaptable alloy product for industrial processing in different manufacturing plants.

EXAMPLE 5

Alloy 1 was twin roll cast to a gauge of 6.05 mm and then cold rolled on an industrial cold mill, without interanneal, to final gauges of 79 μm and 120 μm using conventional pass schedules. Coils of both gauges were then continuously annealed by passing them through a furnace set at a temperature of 499° C. For the 120 μm gauge material this meant a strip speed of 125 m/min and a duration within the furnace of around 8 seconds. For the 79 μm gauge foil the strip speed was 160 m/min giving a duration within the furnace of around 6 seconds. The mechanical properties are shown in Table 9.

TABLE 9

| Gauge, (μm) | Test direction | YS | UTS | E | UTS × E |
|---|---|---|---|---|---|
| 120 | L | 123 | 166 | 18.7 | 3104 |
| | T | 128 | 163 | 20.8 | 3390 |
| 79 | L | 113.4 | 165 | 19.2 | 3168 |
| | T | 115 | 160 | 20.0 | 3200 |

The product at 120 μm gauge was then successfully formed into deep drawn, smooth-walled containers with no sign of any surface blackening. Likewise, the 79 μm gauge product was formed into wrinkle-wall containers with no sign of surface blackening.

An alloy of the following composition: Fe 1.50, Si 0.60 and Mn 0.09, other elements <0.05 each and <0.15 in total, balance Al, was twin roll cast to a gauge of 6.29 mm and then cold rolled on an industrial mill to a gauge of 135 μm using conventional pass schedules. It was then subjected to simulated continuous annealing treatments of 10 minutes in a furnace at 325, 350 and 375° C. The mechanical properties are shown in Table 10.

TABLE 10

| | 325° C. T | 325° C. L | 350° C. T | 350° C. L | 375° C. T | 375° C. L |
|---|---|---|---|---|---|---|
| YS | 129 | 130 | 117 | 117 | 107 | 105 |
| UTS | 163 | 168 | 160 | 164 | 159 | 160 |
| E | 19 | 19 | 24 | 21 | 24 | 23 |
| UTS × E | 3097 | 3192 | 3840 | 3444 | 3960 | 3680 |

The results from this Example show that it is possible, with an alloy made according to the invention and on an industrial scale continuous annealing line, to achieve a very good combination of properties in both longitudinal and transverse directions. These results also show that it is possible with the alloy and process according to the invention to obtain similar properties over a wide range of gauges and strip speeds. A consistent annealing response like this is very useful for flexible manufacturing.

In addition, the consistency of results when compared with the industrial scale batch annealing results of Example 3, show that the alloy and process of the invention enables highly flexible manufacturing in the sense that a producer is not limited to a single set of available heat treatment facilities but can switch from batch annealing to continuous annealing and still expect similar product characteristics.

The invention claimed is:

1. A process of manufacturing an aluminium alloy product comprising the following steps:

(a) continuous casting an aluminium alloy melt of the following composition, (in weight %):

Fe 1.1-1.7,
Si 0.62-0.8,
an Fe:Si ratio between 1.5 and 2.58,
Mn 0.05-0.25,
other elements less than or equal to 0.05 each and less than or equal to 0.15 in total, and
a balance of aluminium;

(b) cold rolling the cast product without an interanneal step to a gauge below 200 μm; and (c) final annealing the cold rolled product.

2. A process according to claim 1 in which the continuous casting (a) takes place in a twin roll caster.

3. A process according to claim 1 in which the Fe content is 1.2 to 1.6 weight %.

4. A process according to claim 1 in which the Si content is 0.62 to 0.7 weight %.

5. A process according to claim 1 in which the predominant intermetallic phase is the cubic α-AlFeSi phase.

6. A process according to claim 1 in which the Mn content is 0.05 to 0.20 weight %.

7. A process according to claim 6 in which the Mn content is 0.05 to 0.15 weight %.

8. A process according to claim 1 in which the final anneal (c) is a batch anneal.

9. A process according to claim 8 in which the batch anneal is carried out within the temperature range 300 to 420° C.

10. A process according to claim 9 in which the batch anneal is carried out within the temperature range 300 to 380° C.

11. A process according to claim 10 in which the batch anneal is carried out within the temperature range 320 to 380° C.

12. A process according to claim 1 in which the final anneal (c) is a continuous anneal.

13. A process according to claim 12 in which the continuous anneal is carried out within the temperature range 400 to 520° C.

14. A process according to claim 13 in which the continuous anneal is carried out within the temperature range 450 to 520° C.

15. A process according to claim 1 in which the aluminium alloy product is made into a deep drawn container following steps (a)-(c).

16. A process of manufacturing an aluminium alloy product comprising the following steps:

(a) continuous casting an aluminium alloy melt of the following composition, weight %):

Fe 1.1-1.7,
Si 0.62-0.8,
Mn 0.05-0.25,
other elements less than or equal to 0.05 each and less than or equal to 0.15 in total, and
a balance of aluminium;

(b) cold rolling the cast product without an interanneal step to a gauge below 200 μm; and (c) final annealing the cold rolled product, in which the final annealing is a continuous anneal.

* * * * *